US007721664B2

(12) United States Patent
Woolley

(10) Patent No.: US 7,721,664 B2
(45) Date of Patent: May 25, 2010

(54) FEED DIRECTION CHANGE ASSEMBLY FOR SEWING MACHINE

(75) Inventor: Thomas H. Woolley, Lomita, CA (US)

(73) Assignee: Julie Graves, Longmeadow, MA (US)

( * ) Notice: Subject to any disclaimer, the term of this patent is extended or adjusted under 35 U.S.C. 154(b) by 0 days.

(21) Appl. No.: 11/812,278

(22) Filed: Jun. 18, 2007

(65) Prior Publication Data

US 2008/0308028 A1 Dec. 18, 2008

(51) Int. Cl.
*D05B 27/00* (2006.01)
*D05B 27/22* (2006.01)
*D05B 35/00* (2006.01)

(52) U.S. Cl. ..... 112/314; 112/315

(58) Field of Classification Search ..... 112/314, 112/323, 324, 260, 470.13, 309, 63, 315–317
See application file for complete search history.

(56) References Cited

U.S. PATENT DOCUMENTS

| | | | | | |
|---|---|---|---|---|---|
| 2,893,337 | A | * | 7/1959 | Irmscher | 112/199 |
| 3,911,841 | A | * | 10/1975 | Johnson | 112/184 |
| 4,493,280 | A | * | 1/1985 | Bianchi | 112/260 |
| 4,539,925 | A | * | 9/1985 | Shim | 112/314 |
| 4,691,654 | A | * | 9/1987 | Meier | 112/303 |
| 4,854,251 | A | * | 8/1989 | Hiramatsu et al. | 112/470.06 |
| 4,889,062 | A | * | 12/1989 | Orii | 112/318 |
| 5,154,590 | A | * | 10/1992 | Klein | 112/260 |
| 5,163,376 | A | * | 11/1992 | Frye | 112/63 |
| 5,337,686 | A | * | 8/1994 | Nagata | 112/260 |

* cited by examiner

*Primary Examiner*—Ismael Izaguirre

(57) ABSTRACT

The purpose of this invention is to change the direction of the feed so that the user/operator can now use the free arm of the sewing machine to the optimum advantage. The conventional domestic free arm sewing machine has, heretofore, been limited to sewing in a lateral direction across the free arm. The use of this invention allows the machine to be used so that tubular shaped garments can travel along and around the free arm of the sewing machine this sewing can be accomplished with any outside seams, something, heretofore, impossible with a conventional free arm sewing machine.

2 Claims, 5 Drawing Sheets

PART NUMBERS ARE CIRCLED ◯
P.A – IS PRIOR ART

PART NUMBERS ARE CIRCLED ◯

P.A – IS PRIOR ART

FEED DIRECTION CHANGE ASSEMBLY FOR SEWING MACHINE

BACKGROUND OF THE INVENTION

1. Field of the Invention

This invention relates to domestic sewing systems, and in particular, for sewing work-pieces into tubular shapes.

2. Description of Related Art

Domestic sewing machine operators often desire the ability to sew a work-piece into a tubular or closed loop shape. To create this tubular shape, two opposing edges, of the work-piece, would be joined together by overlapping one edge of one side of the work-piece over an edge of the opposing side of the work-piece. The edges, of the work-piece would be sewn by hand or manually guided into a sewing machine, passing over the feed plate and across the feed arm in a linear direction. Typically, the work-piece can move in only one direction, back and forth, over the free arm of the prior art, allowing the operator to sew only the edge of two work-pieces, but not the ability to sew an inseam, or side pockets or a stripe down the side of the pant leg (i.e. tuxedo pant leg). There is, therefore, a need to provide domestic sewing operators the ability to sew two work-pieces into tubular shapes, which requires the material to be fed through the feed plate in a sideways fashion. The feed direction change assembly offers the domestic user the ability to do so.

SUMMARY OF THE INVENTION

The objective of the invention is to change the feed direction of two work-pieces into a sideways position which will enable the operator to make tubular and closed loop shapes. The invention will improve prior art. Conventional domestic free arm sewing machines are limited in the work-pieces are sewn in an anterior to posterior direction across the free arm. The feed direction change assembly proposed here changes the arc of work-piece pied to a parallel orientation in relation to the free arm which will produce the desired tubular, closed loop shape. Conventional machines now offer only perpendicular orientation of work-pieces to the free arm, which disallows tubular and closed loop operation. The invention is comprised of several mechanical parts that do not require a change in prior art, it is rather an easily assimilated improvement on existing technology. The assembly, comprised of nine parts, can easily be replaced and will not adversely affect the overall function of the sewing system if a repair is needed. Additionally, the invention does not require changes in computer technology, which provides manufacturers the added advantage of integrating a manageable improvement without the need to alter already existing internal mechanisms. The assembly is easily modified and can be made to adapt to manufacturing design templates of any sewing machine device. For purposes of example, the design shown here is based on a Brother VX-957 but can be changed to adapt to any commercially sold machine.

BRIEF DESCRIPTIONS OF THE DRAWINGS

PHYSICAL DESCRIPTION OF THE ASSEMBLY

Figure 1:
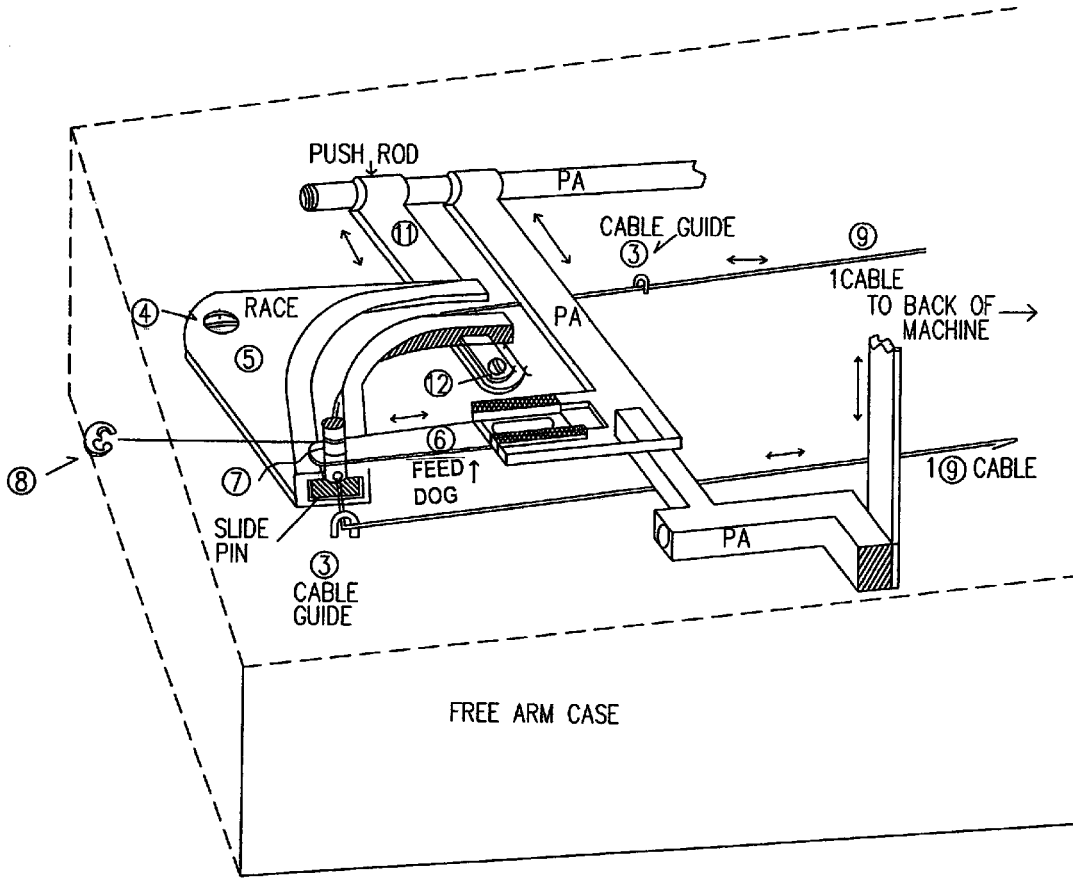
FIG. 1 shows the race assembly connected to the bed of the free arm of the sewing machine with the push rod connected to the prior art, and the slide pin (with the cable) inserted into the raceway with the feed dog in the longitudinal position (to sew sideways or to the left or right) along the free arm instead of across the free arm.
Figure 2:
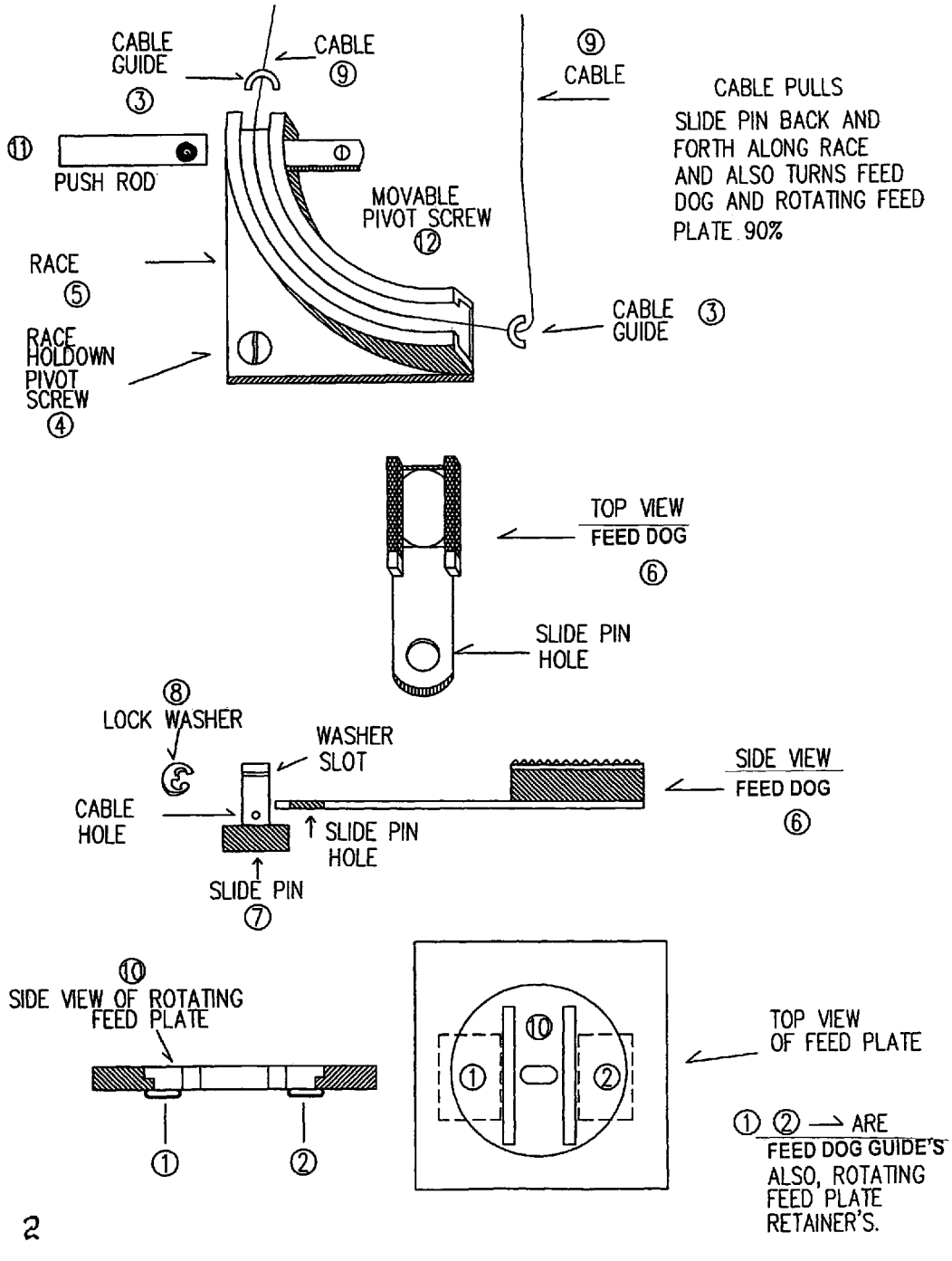
FIG. 2 shows the race from the top view, the feed dog from the top and from the side. The slide pin from the side view and the feed plate from the side view and the top view and the feed dog guides 1 and 2 which also holds down the feed plate.
Figure 3:
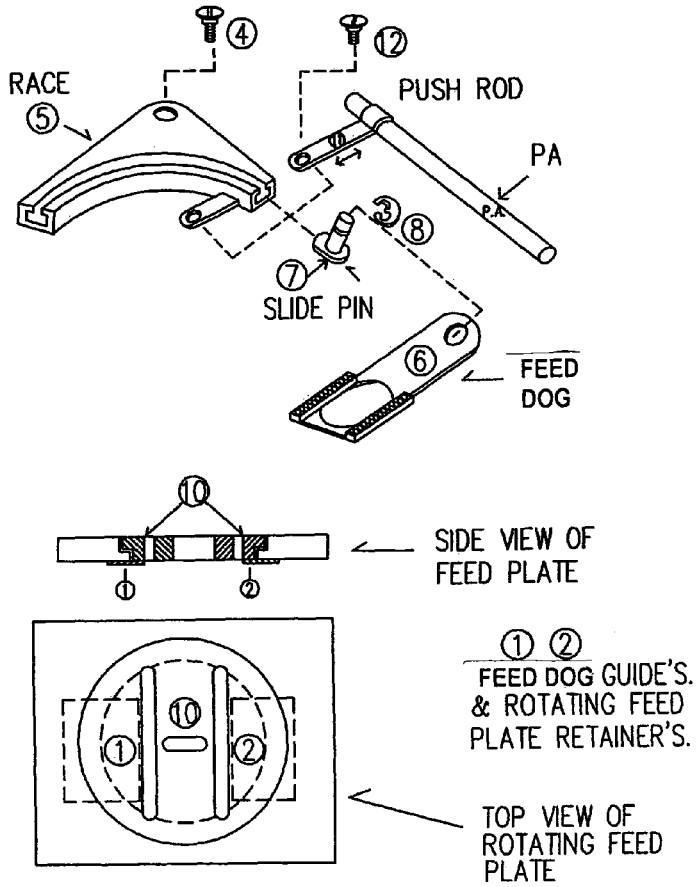
FIG. 3 shows how the different parts go together and where the feed plate retainers are located on the feed plate.

1. Swivel plate hold down (1, 2 on FIG. 2) Attached to the bottom of the swivel plate. Rectangular in shape with curved edges along the sides that line up the outer edge of the disc. They are located on either side of the slotted opening and are approximately (this will vary according to prior art specifications) ¼ inch long and ¼ inch wide. They consist of a thin metal material and fit in a parallel orientation along the slotted openings of the swivel plate. The purpose of the hold down is to secure the feed plate from moving around during operation of the machine.
2. Second swivel plate hold down
3. Cable guide (3 on FIG. 1) A small hook-like structure that is welded in place at both ends at the anterior end of the raceway, It is approximately ⅛ inch wide and protrudes ⅜ inch high, allowing enough room for the cable. It is located on the left front part of the raceway mechanism.
4. Raceway hold down pivot screw (4 on FIG. 3) A ¼ inch standard countersunk screw that allows the raceway to move back and forth with the prior art.
5. Raceway assembly (5 on FIG. 2) A 2-inch by 2 inch metal piece with two straight edges that meet at a rounded corner. A screw hole is drilled ⅛ inch from the corners edge. It provides a space for the raceway hold down screw. The raceway is triangular in shape; the third side has a cut out on the ninety degree curved edge. A ½-inch by ¼-inch metal prong is located at the anterior portion of the right lateral edge of the prong and is used to fasten the raceway to the pushrod. Two slightly raised curved metal slots sit on top of the bottom 2 inch by 2 inch piece. The slots are separated by approximately ⅜ inch. There is a lip on the inside edge of each slot that holds the cable in place. The slots are arced at ninety degrees and act as a guide for the cable and slide pin.
6. Feed dog (6 on FIG. 1) Made of thin metal, the feed dog is 1⅞ inches long and ½ inch wide. It consists of two pieces of metal that are welded together. The first piece is 1⅛ inch long by ½ inch wide. It has rounded corners at its free end. This end has a ¼-inch diameter hole which is occupied by the slide pin. The other end is welded to the head of the feed dog. The feed dog head is comprised of two ½ inch long by 1/16 inch wide serrated pieces that are separated from each other by ⅜ inch. There is a cut out between the two pieces and a connector piece at the far end. The other end is welded to the first piece described above.
7. Slide pin (7 on FIG. 2) The side pine is ½ inch high and 3/16 inch in diameter. It is cylindrical in shape. A ¼-inch high solid cylinder sits on tip of a ⅛-inch base. The cylinder portion has a grooved slot around the tip of the pin that acts as a resting place for a lock washer. At the bottom of the cylinder a cable hole has been drilled and provides a space for the cable to thread through.
8. Lock washer (8 of FIG. 2) The lock washer is a standard washer. One side has been cut out and grooves have been carved that fit into the head of the slide pin. The function is to hold the slide pin in place during operation.
9. Cable system A standard upholstery thread sized cable, 26 inches longs is used as a pulley lever to guide the slide pin through the slotted raceway. The cable threads through the interior of the machine. It emerges under the frame at the back of the machine. It is the threaded through two holes placed around the edges of a rounded plastic cap. The cable is tied into knots and secured by heavy-duty glue to the outside edge of the cap. The inside part of the cap has a round female attachment site which receives a male part that is screwed into the lower back part of the machine. The cap has a plastic cylinder tube that acts as a handle. The operator uses the attached plastic cylinder to turn the plastic cap, an action that draws the cable back and forth in the desired motion. This action moves the feed dog along a ninety-degree arc and provides the essential direction change needed to produce the desired tubular shape. The cable is threaded through a hole in the slide pin. It travels the length of the curved slot on the raceway and continues through the machine until it emerges at the back where it is secured by the plastic cap. There is a final plastic cover that protects the cap and inner components. It is 4 inches long, 3 inches wide and 1 inch high. There is a center cutout the same size of the cap where the cap fits into place. The cover has three hold down tabs that fit into holes drilled into the prior art. The tabs hold the cover in place. The bottom portion of the cover is open. The opening allows for a plastic cylinder that acts as a carrier for the cable. The purpose of the carrier is to protect the cable from wear and tear.

Figure 4:
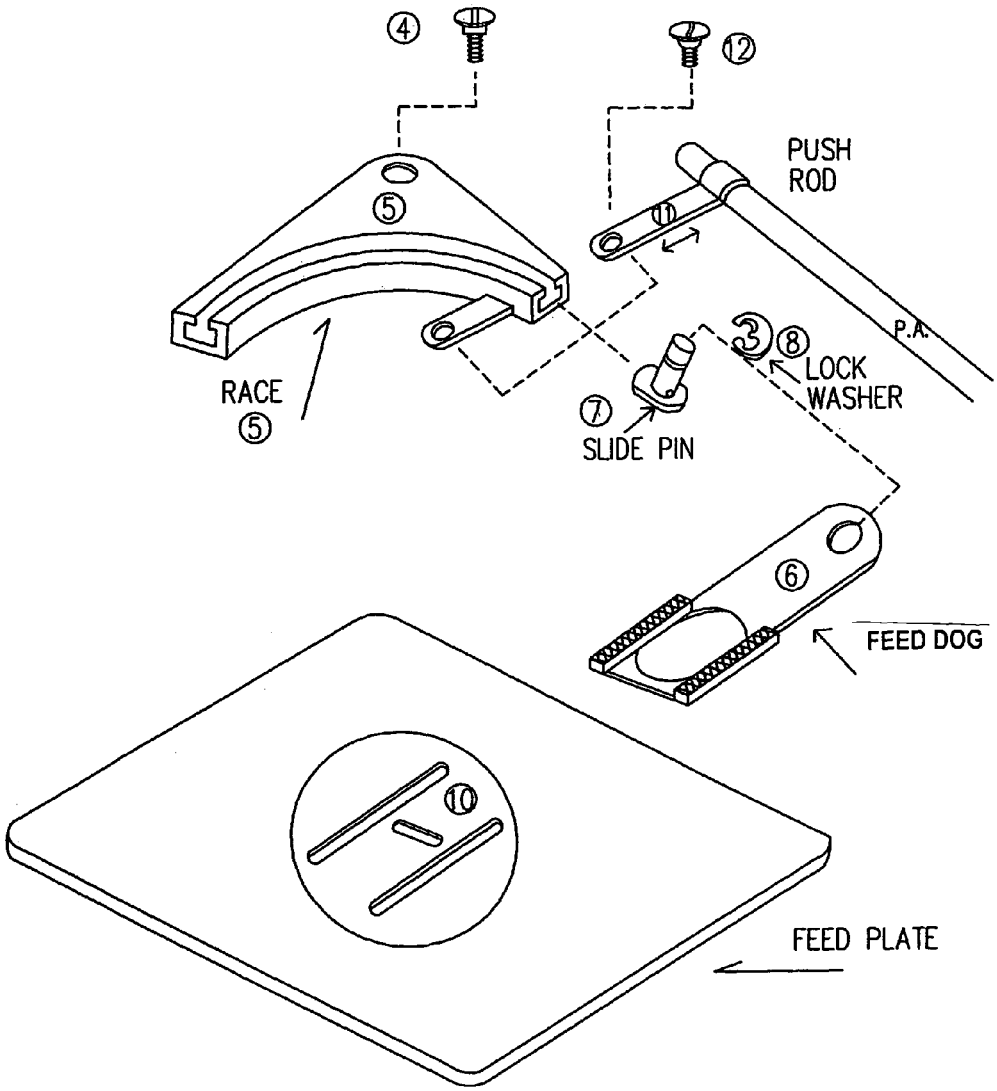
FIG. 4 shows how the feed dogs align with the feed plate, and shows a larger picture of the raceway as in FIG. 3.
Figure 5:
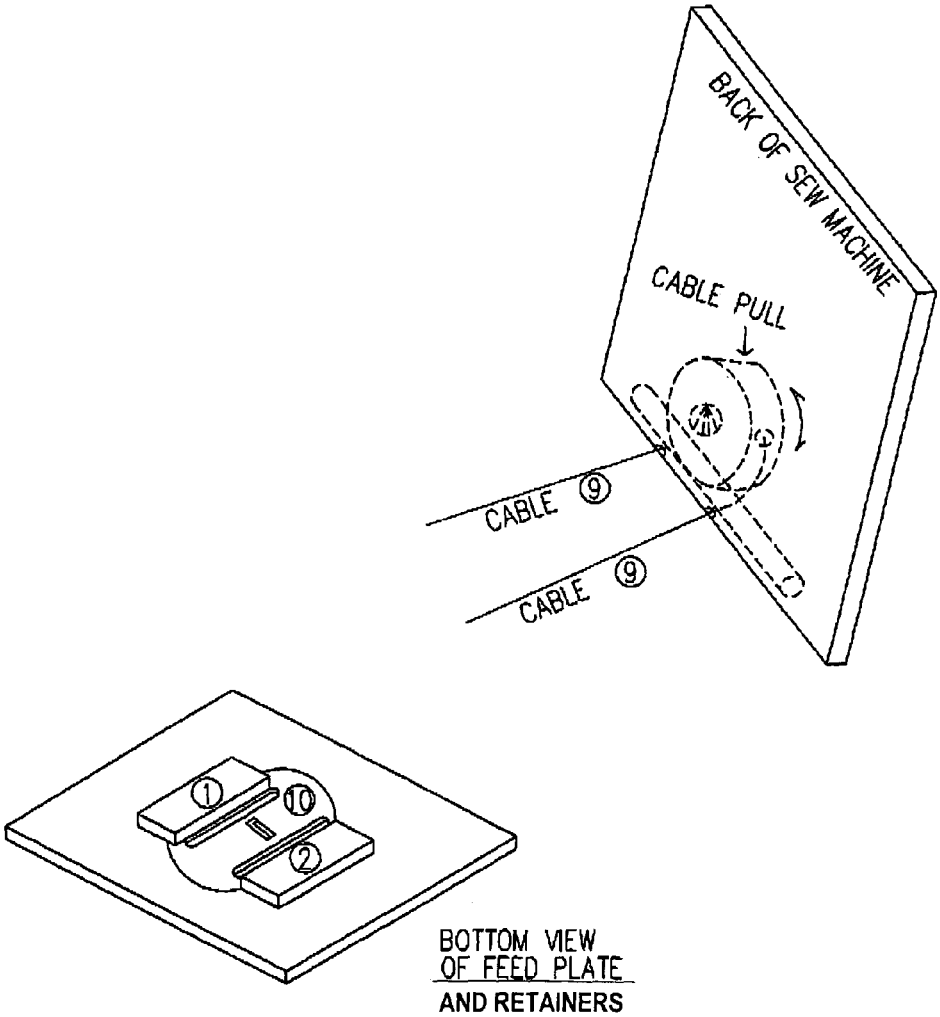
FIG. 5 shows the feed plate, upside down showing the feed plate retainers and feed plate guides (they do both jobs) and the inside back of the sewing machine with rotating cable knob assembly.

10. Swiveling feed plate (10 on FIG. 2) The swivel feed plate is comprised of an 1⅛ inch round metal disc with two slotted openings (1/16 inch wide) that runs parallel to each other along the length of the disc. They are separated by approximately ⅜ inch. These openings provide a space for the feed dog to emerge and mimic the shape of the feed dog. There is a center hole located between the feeds and runs perpendicular to the feed dog slots. It is ¼ inch long and 1/16 inch wide. It is used as a passageway for the needle.
11. Pushrod (11 on FIG. 1) The pushrod is a metal piece approximately 1¼ long and ¼ inch wide. At one end is a screw hole that houses a screw. The screw secures the pushrod to the prong on the raceway. The other end of the metal piece runs under the raceway as it is wrapped around a metal bar of the prior art. It then connects back onto itself forming a ring around the bar. This stabilizes the pushrod to the raceway and additionally connects the feed direction change assembly to the prior art. The attachment to the prior art allows the assembly to move in the desired back and forth direction.
12. Small screw (12 on FIG. 4) The screw fastens the prong on the raceway to the pushrod.

DESCRIPTION OF THE INVENTION

The following description of the sewing machine is for the purpose of example only. Modifications and alterations can be made to better allow for precision tolerances and efficiency of operation. The descriptions and any measurements, in this example, are approximate and are for a domestic free arm sewing machine. The descriptions referenced by part numbers 1, the raceway (5) is mounted to the bottom of the inside of the free arm, then the slide pin (7) is inserted into the raceway slot along with the cable (9) which is fastened to the slide pin (7) then the feed dog hole is put over the slide pin (7) the lock washer (8) into the slot on the slide pin (7) then the rocking raceway is fastened to the prior art, with the push rod (11).

How this Invention Works

Know the prior art as a back and forth action which makes the raceway rock back and forth so that when the feed dogs are in the back and forth sewing position, which is the way the sewing machine normally runs, so that when the cable is pulled that it makes the slide pin move along the raceway. This then changes the direction of the feed, the feed dogs, and the feed plate so now the feed dogs and feed plate are sewing in the sideways mode which (as in the drawing on page 1 of 5) means that the feed dogs are now sewing along the free arm, hence the feed directional change of the sewing machine (left and right). The free arm sewing machine can now be used to optimum advantage. Tubular shaped garments can now be sewn using an outside seam. No longer is the user/operation limited to sewing in the conventional manner. Pockets can be sewn on the outside of pant legs, something that cannot be done on a conventional machine. Stripes can now be sown along pant legs of tuxedos, and other types of pants, or any other customized stitching along the length of the pant leg, or sleeve, and dresses and leggings because outside seams can now be sewn with a lock stitch. Accordingly I claim the following as my objects and advantages: to provide a modification for the free arm sewing machine which allows for new sewing applications and uses. Tubular shaped garments can now be sewn with two outside seams with a conventional lock stitch which is superior to the chain stitch which is normally used. A lock stitch creates a better and stronger seam. This invention allows for the full use of the free arm, as tubular shaped garments can be placed over and along the length of the free arm, as the free arm passes through the center of the garment. An additional advantage is that the user does not have to purchase alternate sewing devices as this invention allows for the full use of the free arm, hence a fuller use of the sewing machine and it is self contained within the sewing machine.

CONCLUSION AND SCOPE OF THE INVENTION

While this description contains many specifics, the reader should not construe these as limitations of the scope of the invention but merely as exemplifications of the preferred embodiments thereof. Others, skilled in the art, will surely envision many other possible variations and applications. This same type of configuration may also be used on conveyor systems to change their direction, or on any other types of machines which are similarly designed, where it would be desirable to have the option to change direction of the feed. The use of this invention may be applicable to industrial and commercial machines. The commercial ramifications of this invention can be directly beneficial to the cottage industry since the sewing machine will have a wider range of applications.

The invention claimed is:

1. A feed direction change assembly for a sewing machine, comprising:

a) a rocking raceway having a raceway slot, wherein the raceway slot provides a space for a slide pin to move along on a ninety-degree arc while being pulled by a cable system, b) a slide pin fitted and movable in the slot, the pin rocks a feed dog for feeding a sewing material in a sideways direction, c) a user actuated cable for moving the pin along in the slot, d) a feed dog assembly connected to the slide pin, wherein the feed dog guides work-pieces across the free arm of a sewing machine, e) a feed plate for accommodating the feed dog and turned along with the feed dog.

2. The feed direction change assembly of claim 1 further comprising:

a stitch length changing assembly for changing a stitch length in the sideways direction.

* * * * *